United States Patent [19]

Neuhoff

[11] Patent Number: 4,537,445

[45] Date of Patent: Aug. 27, 1985

[54] CHAIR

[75] Inventor: Uredat Neuhoff, Lindern, Fed. Rep. of Germany

[73] Assignee: Meiko Industrial Co., Ltd., Aichi, Japan

[21] Appl. No.: 513,062

[22] Filed: Jul. 12, 1983

[30] Foreign Application Priority Data

May 10, 1983 [JP] Japan ..... 58-82101

[51] Int. Cl.[3] ..... A47C 3/00

[52] U.S. Cl. ..... 297/300; 297/322

[58] Field of Search ..... 297/300, 301, 304, 320, 297/322

[56] References Cited

U.S. PATENT DOCUMENTS

| | | | |
|---|---|---|---|
| 2,830,650 | 4/1958 | Lorenz | 297/320 |
| 2,961,035 | 11/1960 | Lorenz | 297/84 |
| 4,390,206 | 6/1983 | Faiks et al. | 297/304 X |
| 4,432,582 | 2/1984 | Wiesmann et al. | 297/300 |

FOREIGN PATENT DOCUMENTS

| | | | |
|---|---|---|---|
| 2846360 | 5/1980 | Fed. Rep. of Germany | 297/300 |

*Primary Examiner*—Francis K. Zugel

*Attorney, Agent, or Firm*—Fred Philpitt

[57] ABSTRACT

A chair comprising a box type stationary frame fixed to an upper end of a pole brace erected on leg portions, an L-shaped back rest frame whose lower portion is curved, a base frame for mounting a seat plate, an inclination adjusting mechanism for controlling an inclination of the base frame and the reclining frame to an optional angle in which the reclining frame is axially fixed to a rear portion of the stationary frame and the reclining frame is axially fixed to a rear end portion of the base frame at its curved portion, a horizontal shaft axially supported on a front portion of the base frame and inserted through an almost horizontal long hole provided in the front part of the stationary frame, a gas spring one end of which is pivotally fixed to an inside wall of the stationary frame and the other end of which is pivotally fixed to the horizontal shaft, and an operation lever for switching a push valve of the gas spring, and said operation lever being provided with a lever releasing keeping mechanism for keeping the push valve of the gas spring in open condition and keeping the inclination adjusting mechanism in free condition.

2 Claims, 7 Drawing Figures

CHAIR

BACKGROUND OF THE INVENTION

This invention relates to a chair of the so called reclining type capable of adjusting and fixing freely an angle of inclination of a back rest and a seat plate by means of a gas spring and more particularly, to a chair comprising a stationary frame fixed to a pole brace erected on legs, a back rest frame for mounting a back rest, a base frame for mounting a seat plate, and inclination adjusting mechanism for tilting and fixing the back rest at an optional angle in the condition where a vertical motion of the front portion of the base frame is small and slidably shifting the base frame in backward direction by following the inclination of the back rest frame, and a lever releasing keeping mechanism for keeping the inclination adjusting mechanism in a free condition.

Heretofore, in a chair in which the seat plate is horizontally fixed and only the back rest is reclined, when the back rest is reclined, the gap between the rear end of the seat plate and the lower end of the back rest changed changes. When the back rest is pushed backward while a person is sitting on the seat plate, clothing such as shirts or the like is turned up. If the back rest is on the tilt, the seat plate remains in a horizontal condition so that the body of the person tends to slip over forward which results in an unstable posture of the person and in an uncomfortable seating.

On a other hand, the chair in which the seat plate and the back rest are built in an integral unit and the unit is capable of reclining backward has been proposed, but in a chair having the foregoing construction, the reclining occurs centering around the pole brace as a fulcrum which supports the center of the seat plate, the front end of the seat plate rises according to the tilting of the seat plate, and as the result, the feet float or the seating becomes uncomfortable.

Moreover, in a chair in which the inclination of the back rest or the seat plate is adjusted and fixed by a gas spring, the gas spring becomes free only when the operation lever for switching the push valve of the gas spring is held down by hand which enables the reclining of the back rest or the like to change, and when the gas spring is locked and the back rest is fixed to an optional angular position. Therefore, as described in the foregoing, those conventional chairs have drawbacks which are not suitable for allowing a person to take free postures which relieve tensions by fixing the angle of inclination of the back rest or the seat plate.

SUMMARY OF THE INVENTION

This invention provides a chair in which the stationary frame and the back rest frame and the base frame are mutually and axially fixed to be interlocked, and the operations of the back rest frame and the base frame are adjusted and controlled by the gas spring, whereby the back rest frame and the base frame are reclined and fixed simultaneously and steplessly.

Moreover, this invention provides a comfortable chair having the construction in which the statationary frame and the back rest frame and the base frame are mutually interlocked and a rear portion of the base frame is lowered centering around a front end portion of the base frame as the fulcrum, whereby the vertical motion of the front edge of the seat plate is minimized and as the result, no matter how the back rest and the seat plate are changed, a person can always sit on the chair in a comfortable posture and moreover when the back rest is reclined backward, there is no problem of floating of the feet, thereby eliminating the conventional drawbacks.

Furthermore, this invention has eliminated inconveniences of turning up of shirts of the person in the process of reclining the back rest backward as found in the conventional chair by forming the construction so that the base frame follows slidably the reclining of the back rest when the back rest is reclined backward which allows almost no change of the gap between the back rest and the seat plate.

Also, this invention provides a chair in which a lever releasing keeping mechanism including a stopper member for holding the push valve in open condition is provided on an operation lever for switching the push valve of the gas spring so that the chair can be used in either way, namely, in the case wherein the back rest and the seat plate are retained in fixed condition and in case the back rest and the seat plate are retained in free condition. Also, in the case wherein the reclining of the back rest and the seat plate is set in a free condition, the reclining of the back rest and the seat plate follows according to the posture of the body which changes the angle of inclination freely.

DETAILED DESCRIPTION OF THE INVENTION

Figure 1:
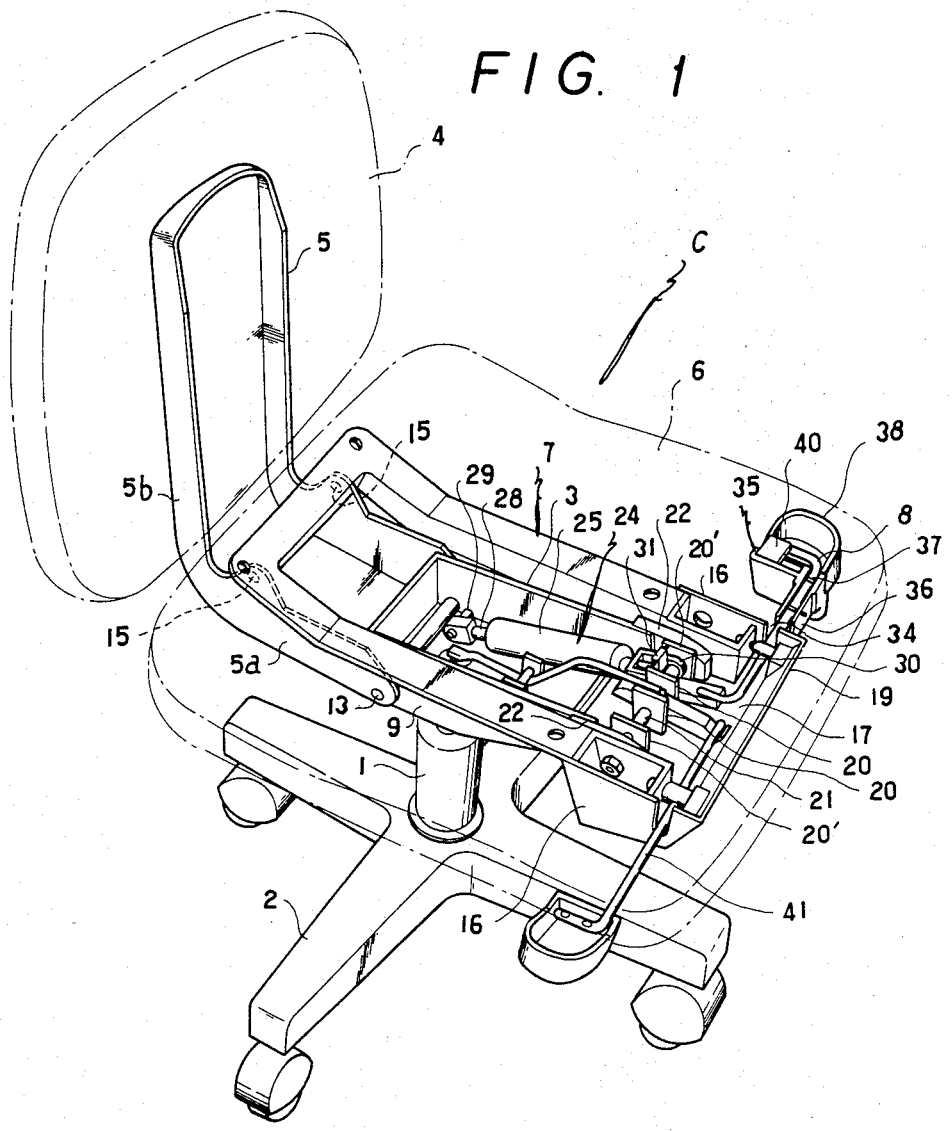
FIG. 1 is an exterior perspective view.
Figure 2:
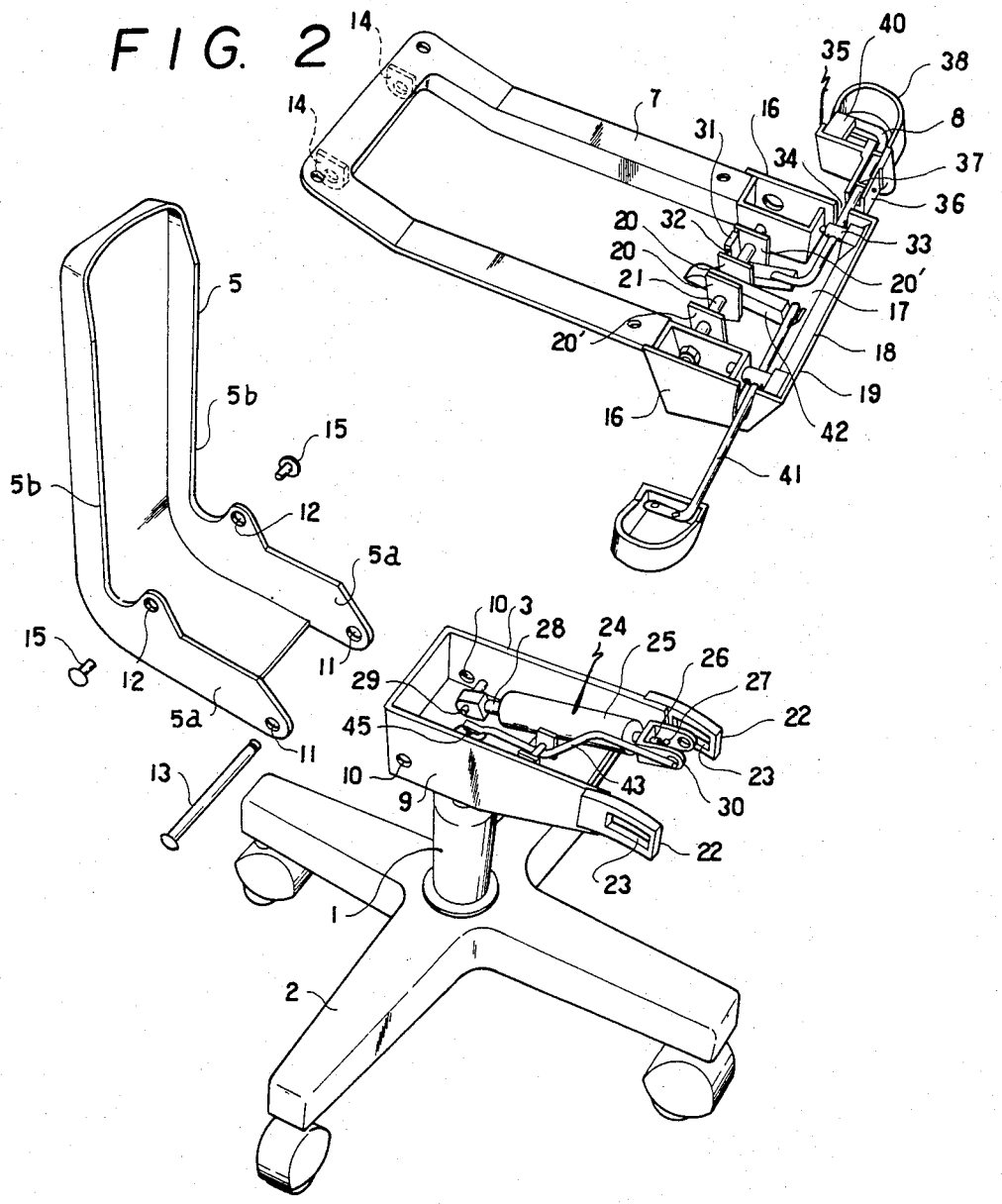
FIG. 2 is a decomposed perspective view.
Figure 3:
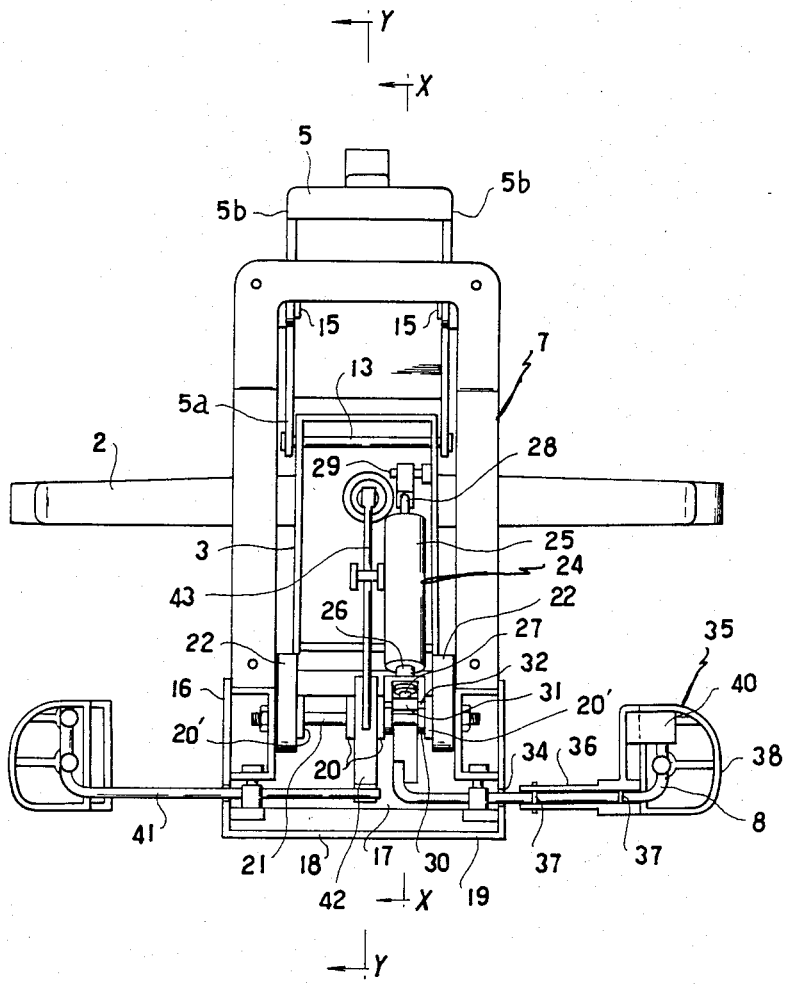
FIG. 3 is a plan view.

The chair of this invention which is represented by an ordinary letter C comprises leg portions 2 provided with a pole brace 1, a stationary frame 3 fixed to an upper end of the pole brace 1, a back rest frame 5 for mounting a back rest 4, and a base frame 7 for mounting a seat plate 6. The stationary frame 3, the back rest frame 5 and the base frame 7 are mutually and axially fixed to be reclined interlockingly. The base frame 7 is provided with an inclination adjusting mechanism for lowering the rear portion of the base frame 7 by centering around the front portion of the seat plate 6 as the fulcrum, and tilting and fixing the base frame 7 and the back rest frame 5 simultaneously and steplessly at an optional angle, and an operation lever 8 for operating the inclination adjusting mechanism is provided with a lever releasing keeping mechanism for keeping the inclination adjusting mechanism in free condition.

Holes 10 and 10 are perforated on corner portions of rear parts of side surface 9 and 9 of the stationary frame 3. The lower front end portion 5*a* of the back rest frame 5 is curved, and holes 11, 11 and 12, 12 are perforated toward the front end curved portion 5*a* and the bent portion 5*b*, respectively, and the back rest frame 5 is axially fixed to the stationary frame 3 by inserting a shaft 13 through the holes 11, 11 of the front end portion 5*a* and the holes 10 and 10 of the stationary frame 3.

Also, the back rest frame 5 and the base frame 7 are set in place and axially fixed by inserting pins 15 and 15 to the holes 12 and 12 toward the bent portion 5*b* and bearing portions 14 and 14 projecting on the rear end portion of the base frame 7.

The base frame 7 is formed by a channel member shaping both side portions and rear portion along an inner edge in a hook shape. The front edge portion forms a frame having a flat rectangular shaped receiving portion 19 having side walls 16, 16, bottom wall 17 and front wall 18. Bearing members 20, 20, 20', 20' are erected at a predetermined intervals on bottom wall 17 of the receiving portion 19. A horizontal shaft 21 is axially supported by these bearing members 20, 20, 20', 20'.

On the other hand, in the front part of the stationary frame 3, arm members 22 and 22 project, and generally horizontal long holes 23 and 23 are provided on the arm members 22 and 22. The arms are received between the side walls 16 and 16 and the bearing members 20' and 20', and the horizontal shaft 21 is inserted through the long holes 23 and 23.

Reference numral 24 identifies a gas spring for connecting the stationary frame 3 and the horizontal shaft 21. The gas spring 24 is constructed in such way that when a knob 27 of a push valve 26 projecting in one part of a cylinder 25 is pressed, a piston (not shown) which partitions the inside of the cylinder is released and the high pressure gas is shiftable and the locked condition is released, and this time, when the external force applied to a piston rod 28 is larger than the gas pressure, the piston rod 28 is pushed into the cylinder 25, and when the external force is smaller, the piston rod 28 is pushed out from the cylinder 25 inversely.

The tip of the piston rod 28 of the gas spring 24 is fixed pivotally to the inside wall of the stationary frame 3 in the embodiment of this invention, and a fork member 30 fixed to the tip of the push valve 26 is pivotally fixed to the horizontal shaft 21, and a knob 27 projects to the center of the fork member 30. An upper end of a pressing member 31 whose side surface is L-shaped is pivotally fixed at 32 between the bearing members 20 and 20' adjacent the fork member 30, and the surfaces of the pressing member 31 and the knob 27 are arranged to always be in contact. Also, the operation lever 8 is bent in a flat U-shape, and a pivotal portion 33 is axially supported on the receiving portion 19 so the lever may move like a seesaw, wherein its one end is disposed on the upper surface of the rear end of the pressing member 31, and the other end projects to the outside of the base frame 7 from a notch 34 provided on the side wall 16 of the receiving portion 19.

Figure 4:
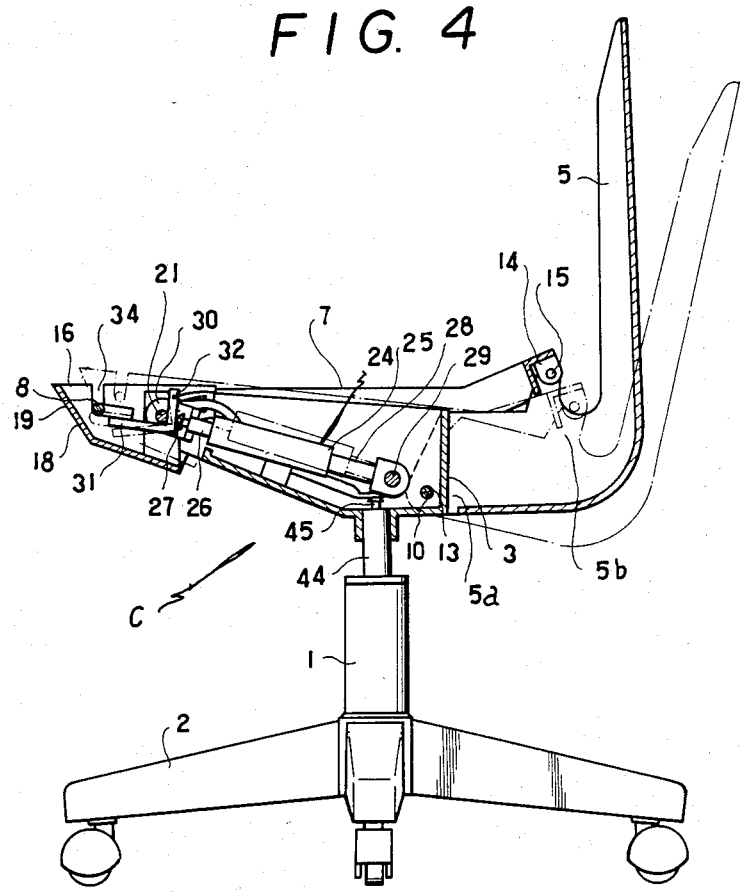
FIG. 4 is a cross sectional view taken along a line X—X of FIG. 3.

As described in the foregoing, the inclination adjusting mechanism of the base frame 7 and the back rest 4 is constructed in such way that the horizontal shaft 21 axially supported on the front portion of the base frame 7 passes through the almost horizontal long hole 23 contained in the front part of the stationary frame 3. One end of the gas spring 24 is pivotally fixed to the inside wall of the stationary frame 3, the other end is pivotally fixed to the horizontal shaft 21, and the push valve 26 of the gas spring 24 is made to open or close by the operation lever 8. The chair of this invention in the normal condition is such that even if a force is applied to the back rest frame 5, the gas spring 24 is locked so that the transfer of the base frame 7 is prevented, and accordingly, the back rest frame 5 is not turned. On the other hand, when the back rest frame 5 is to be turned, the outside end of the operation lever 8 is lifted, and the rear end of the pressing member 31 is lowered as shown by chained line in FIG. 4, whereby the pressing member 31 turns centering around the pivotal portion 32 as fulcrum, and the knob 27 is pressed to release the locking of the gas spring 24. Accordingly, when a backward force is applied to the back rest frame 5 in this condition, the back rest frame 5 is tilted backwardly and the pin 15 is lowered downwardly centering around the shaft 13 as the fulcrum. According to this movement, the base frame 7 is pulled backward, and the horizontal shaft 21 moves along the long hole 23 of the stationary frame 3 thereby compressing the piston rod 28 of the gas spring 24. At this time, the rear portion of the base frame 7 is tilting downwardly centering around the horizontal shaft 21 as the fulcrum so that the front end of the seat plate 6 is only slightly elevated.

When the hand of the person is released from the operation lever 8 at an optional position, the pressing member 31 is pushed back with the restoring force of the knob 27, whereby the gas spring 24 is locked again, and both the base frame 7 and the back rest frame 5 are fixed in the tilting position.

Since the gas pressure is stored in the gas spring 24 in the compressed condition, the locking of the gas spring 24 is released by the manner mentioned above, and when, the force is not applied to the back rest frame 5, the piston rod 28 is expanded by the gas pressure of the gas spring 24, and the horizontal shaft 21 is pushed back to raise the back rest frame 5.

In the embodiment of the invention, although the operation lever 8 is shown in the mounted condition on the base frame 7, it is not limited to this embodiment, and for example, if the operation lever 8 is mounted on the stationary frame 3, the push valve 26 may be fixed to the inside wall of the stationary frame 3 and the piston rod 28 may be pivotally fixed to the horizontal shaft 21.

The operation lever releasing keeping mechanism for maintaining the open position of the push valve 26 of the gas spring 24 and keeping the inclination adjusting mechanism in a free condition may be formed by mounting a stopper member 35 that is movable in axial direction on the operation lever 8.

Namely, a cylinder portion 36 having a U-cross section is includes in the stopper member 35 and is loosely fit to the outer periphery of the operation lever 8. Furthermore, stopper pins 37 and 37 are placed over the open upper surface. Cylinder portion 36 is shiftable between a button member 38 fixed to the outside end of the operation lever 8 and the side wall 16 of the receiving portion 19. On the front end of the cylinder portion 36, a wedge member 39 projects. The wedge 39 is capable of fitting in the gap between the notch 34 of the receiving portion 19 and the lower surface of the operation lever 8, which gap is produced when the push valve 26 is in the open condition after lifting the operation lever 8.

In the drawing, numeral 40 represents a turning preventing member projecting integrally from the upper surface of the stopper member 35, which is placed over the upper surface of the botton member 38.

When the wedge member 39 of the stopper member 35 is fit in the gap between the lower surface of the operation lever 8 and the notch 34 of the receiving portion 19, the knob 27 of the push valve 26 continues to be pressed, and as the gas spring 24 is not locked, the back rest 4 and the seat plate 6 are interlocked on a tilt matching the change of the posture of the person.

When the back rest 4 and the seat plate 6 are to be fixed, the stopper member 35 is slid to the side of the button member 38 while the operation lever 8 is slightly lifted. The wedge member 39 is pulled from the space between the operation lever 38 and the notch 34, and when the hand releases the operation lever 8, the push valve 26 is closed by the restoring force of the knob 27, and the gas spring 24 is locked.

In the embodiment of this invention, the description has been provided on the chair of the type in which the seat plate 6 and the back rest 4 are interlocked, but this invention is, of course, not limited to that embodiment, and even if the back rest 4 or the seat plate 6 is independently tilted as long as the gas spring is used, it demonstrates the similar effect.

Figure 5:
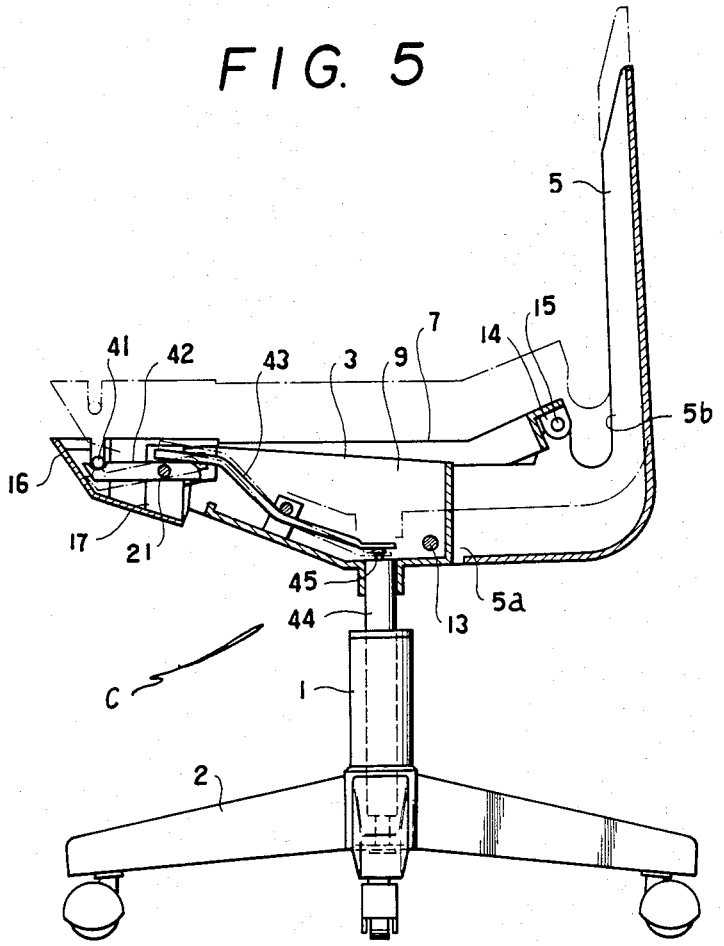
FIG. 5 is a cross sectional view taken along a line Y—Y of FIG. 3.
Figure 6:
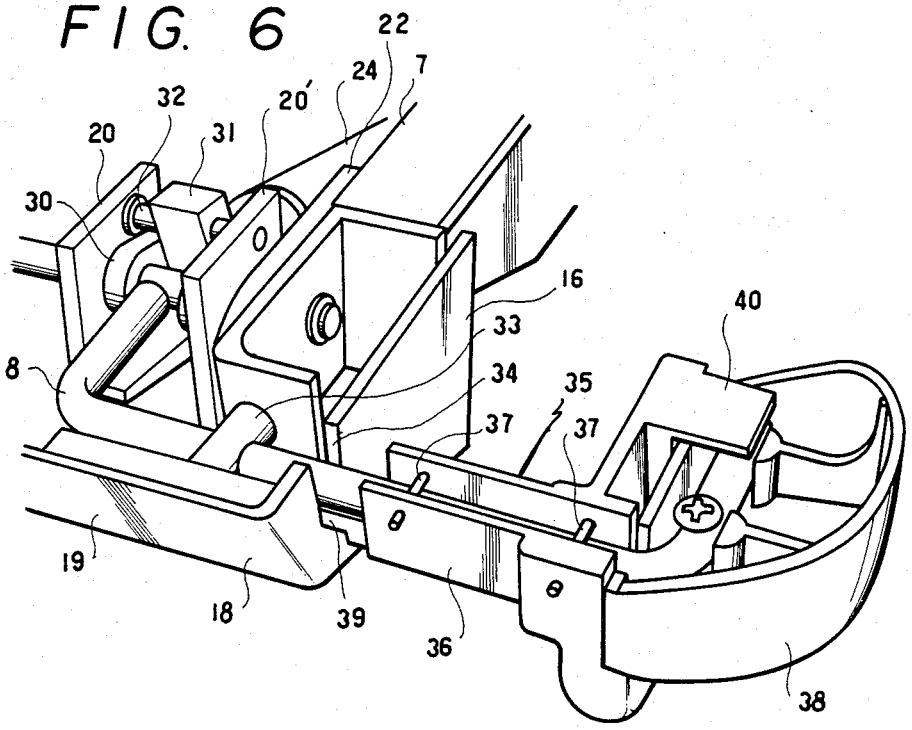
FIG. 6 is a perspective view of an essential part of a holding mechanism.
Figure 7:
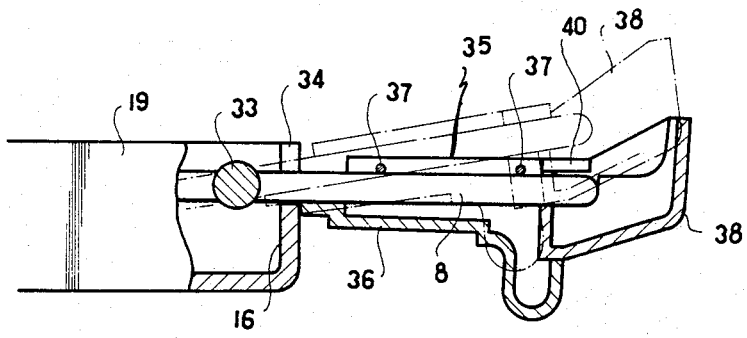
FIG. 7 is a cross sectional view of an essential part of a holding mechanism.

A lever 41 projecting from the opposite side of the operation lever 8 is provided for vertically moving the seat plate 6, and when the outside end of the lever 41 is vertically moved, a lever bar 42 pivotally fixed to the horizontal shaft 21 turns in anti-clockwise direction in FIG. 5, whereby a pressing lever 43 pivotally fixed to the stationary frame 3 is turned by the foregoing turning of the bar 42 in the clockwise direction in the same drawing. A knob 45 of the gas spring 44 built in the pole brace 1 is thereby pressed, and locking of the gas spring 44 is released, and the seat plate 6 can be moved vertically.

Accordingly, this invention is constructed in such a way that the stationary frame and the back rest and the base frame are mutually fixed to be interlocked, and the interlocking movement is controlled by the gas spring so that the back rest frame and the base frame are simultaneously and steplessly tilted and fixed. Since the movement of the base frame comprises a tilting movement centering around the horizontal shaft as the fulcrum, the vertical movement of the front edge of the seat plate is small, and therefore, the conventional drawback of floating of the feet which occurs when the back rest is on the tilt backward is eliminated. When the back rest frame is tilted backward, the base frame slides by following the tilting movement so that the gap between the back rest and the seat plate is almost not changed, and accordingly, the conventional inconvenience of turning up of a shirt in the process of the tilting of the back rest backward has been eliminated. As a result, this invention provides a chair comfortable to sit on. Furthermore, as the stopper member capable of moving back and forth in the axial direction is mounted on the operation member, and the push valve of the gas spring is retained in the open condition by the stopper member, the seat plate or the back rest can be freely tilted by following the change of the posture of the person relaxing, and is useful in releasing tension. When the stopper member is drawn toward the side of the button member, the seat plate or the back rest can be fixed, and the chair can be adjusted to meet the desk work whereby the person can sit on the chair of the invention in a comfortable posture.

What is claimed is:

1. A chair adapted for inclination adjustment comprising:

(a) leg members and a pole brace mounted on said leg members, (b) a box-like stationary frame member mounted on said pole brace, the front portion of said stationary frame member containing a pair of opposed generally horizontally extending slots, (c) a base frame member for mounting a seat plate thereon;

(d) an L-shaped back rest frame member including a horizontal portion, a curved portion and a vertical portion, the free end of said horizontal portion being pivotally fixed to the rear portion of said stationary frame member, said curved portion being axially fixed to the rear portion of said base frame member, (e) a horizontal shaft member supported on the front portion of said base frame member, the respective opposed ends of said shaft member extending through the slots contained in said stationary frame member, (f) a gas spring pivotally fixed at one end to an inner wall of said stationary frame member and pivotally fixed at the other end of said horizontal shaft and including a push valve for actuating said gas spring, and (g) an operation lever for actuating said push valve to operate said gas spring to thereby adjust the inclination of said back rest frame member and said base frame member.

2. A chair as defined in claim 1, wherein said base frame member includes at its front end a receiving portion and said operation lever includes a stopper member slidingly movable along the axis of said operation lever, said operation lever being pivotally fixed to said receiving portion and being pivotal to an upper position to form a gap between said lever and said receiving portion in order to open said push valve, a front portion of said stopper member adapted for insertion in the gap to hold said push valve of said gas spring in an open position.

* * * * *